US008641518B2

(12) United States Patent
Davis et al.

(10) Patent No.: US 8,641,518 B2
(45) Date of Patent: Feb. 4, 2014

(54) TICKET-BASED TRIAL ACCOUNT

(75) Inventors: Dwayne A. Davis, Reno, NV (US); Dwayne R. Nelson, Las Vegas, NV (US)

(73) Assignee: IGT, Las Vegas, NV (US)

( * ) Notice: Subject to any disclaimer, the term of this patent is extended or adjusted under 35 U.S.C. 154(b) by 238 days.

(21) Appl. No.: 13/250,771

(22) Filed: Sep. 30, 2011

(65) Prior Publication Data

US 2013/0084951 A1 Apr. 4, 2013

(51) Int. Cl.
*A63F 9/24* (2006.01)

(52) U.S. Cl.
USPC ..... 463/25; 463/29

(58) Field of Classification Search
USPC ..... 463/25, 29
See application file for complete search history.

(56) References Cited

U.S. PATENT DOCUMENTS 6,267,671 B1 7/2001 Hogan
6,302,793 B1 10/2001 Fertitta, III et al.
6,398,643 B1 6/2002 Knowles et al.
6,578,199 B1 6/2003 Tsou et al.
6,620,046 B2 9/2003 Rowe
6,652,380 B1 11/2003 Luciano
6,712,697 B2 3/2004 Acres
6,722,985 B2 4/2004 Criss-Puszkiewicz et al.
6,722,986 B1 4/2004 Lyons et al.
6,776,715 B2 8/2004 Price
6,848,995 B1 2/2005 Walker et al.
6,908,387 B2 6/2005 Hedrick et al.
6,997,807 B2 2/2006 Weiss
7,025,674 B2 4/2006 Adams et al.
7,083,518 B2 8/2006 Rowe
7,083,520 B2 8/2006 Rowe
7,094,149 B2 8/2006 Walker et al.
7,112,138 B2 9/2006 Hedrick et al.
7,198,571 B2 4/2007 Lemay et al.
7,303,470 B2 12/2007 George et al.
7,303,475 B2 12/2007 Britt et al.
7,311,605 B2 12/2007 Moser
7,318,774 B2 1/2008 Bryant et al.
7,526,447 B2 4/2009 Rowe
7,611,411 B2 11/2009 Griswold et al.
7,617,151 B2 11/2009 Rowe
7,674,180 B2 3/2010 Graham et al.
7,701,344 B2 4/2010 Mattice et al.
7,740,538 B2 6/2010 Nguyen et al.
7,749,081 B1 7/2010 Acres
7,758,429 B2 7/2010 Crivelli et al.
7,775,876 B2 8/2010 Rowe
7,780,525 B2 8/2010 Walker et al.
7,862,430 B2 1/2011 Baerlocher et al.
7,867,081 B2 1/2011 Schneider et al.
7,892,092 B2 2/2011 Matthews et al.
7,927,212 B2 4/2011 Hedrick et al.
7,985,133 B2 7/2011 Baerlocher et al.
7,988,551 B2 8/2011 Walker et al.
7,993,199 B2 8/2011 Iddings et al.
8,012,009 B2 9/2011 Iddings et al.

(Continued)

*Primary Examiner* — Corbett B Coburn
(74) *Attorney, Agent, or Firm* — Neal, Gerber & Eisenberg LLP

(57) ABSTRACT

Disclosed herein are techniques and equipment for providing a temporary ID for a player tracking account. The temporary ID may be created by a first player with a first level of access to a first player tracking account. The temporary ID may be used by a second player to gain a second level of access to the player tracking account. The second level of access may be less than the first level of access.

19 Claims, 10 Drawing Sheets

(56) References Cited

U.S. PATENT DOCUMENTS

| | | | | |
|---|---|---|---|---|
| 8,057,298 | B2 | 11/2011 | Nguyen et al. | |
| 8,096,873 | B2 | 1/2012 | Walker et al. | |
| 8,135,644 | B2 | 3/2012 | Rowe | |
| 8,202,156 | B2 | 6/2012 | Bartholomew | |
| 2002/0123376 | A1 | 9/2002 | Walker et al. | |
| 2002/0155887 | A1 | 10/2002 | Criss-Puszkiewicz et al. | |
| 2003/0013513 | A1 | 1/2003 | Rowe | |
| 2003/0028480 | A1* | 2/2003 | Rowe | 705/39 |
| 2003/0083943 | A1 | 5/2003 | Adams et al. | |
| 2003/0212597 | A1 | 11/2003 | Ollins | |
| 2003/0232647 | A1 | 12/2003 | Moser | |
| 2004/0113360 | A1 | 6/2004 | George et al. | |
| 2004/0142742 | A1 | 7/2004 | Schneider et al. | |
| 2004/0166931 | A1 | 8/2004 | Criss-Puszkiewicz et al. | |
| 2004/0214622 | A1 | 10/2004 | Atkinson | |
| 2005/0003890 | A1 | 1/2005 | Hedrick et al. | |
| 2005/0009601 | A1 | 1/2005 | Manfredi et al. | |
| 2005/0124411 | A1* | 6/2005 | Schneider et al. | 463/29 |
| 2005/0143166 | A1 | 6/2005 | Walker et al. | |
| 2005/0153768 | A1 | 7/2005 | Paulsen | |
| 2005/0153773 | A1 | 7/2005 | Nguyen et al. | |
| 2005/0239546 | A1 | 10/2005 | Hedrick et al. | |
| 2005/0261059 | A1 | 11/2005 | Nguyen et al. | |
| 2005/0261060 | A1 | 11/2005 | Nguyen et al. | |
| 2005/0261061 | A1 | 11/2005 | Nguyen et al. | |
| 2006/0143085 | A1 | 6/2006 | Adams et al. | |
| 2006/0148561 | A1 | 7/2006 | Moser | |
| 2006/0277100 | A1 | 12/2006 | Parham | |
| 2007/0167210 | A1* | 7/2007 | Kelly et al. | 463/16 |
| 2008/0051195 | A1 | 2/2008 | Hedrick et al. | |
| 2008/0076496 | A1 | 3/2008 | Baerlocher et al. | |
| 2008/0076534 | A1 | 3/2008 | Iddings et al. | |
| 2008/0076542 | A1 | 3/2008 | Iddings et al. | |
| 2008/0076571 | A1 | 3/2008 | Freking | |
| 2008/0076576 | A1 | 3/2008 | Graham et al. | |
| 2009/0082109 | A1 | 3/2009 | Sepich et al. | |
| 2009/0270180 | A1 | 10/2009 | Stewart | |
| 2009/0276341 | A1* | 11/2009 | McMahan et al. | 705/30 |
| 2010/0120499 | A1 | 5/2010 | Cohen | |
| 2010/0267444 | A1 | 10/2010 | Walker et al. | |
| 2011/0212764 | A1 | 9/2011 | Baerlocher et al. | |
| 2011/0269545 | A1 | 11/2011 | Kelly et al. | |
| 2012/0088573 | A1 | 4/2012 | Hedrick et al. | |
| 2013/0084961 | A1 | 4/2013 | Radisich et al. | |
| 2013/0084962 | A1 | 4/2013 | Radisich et al. | |
| 2013/0084994 | A1 | 4/2013 | Farrar | |

* cited by examiner

TICKET-BASED TRIAL ACCOUNT

TECHNICAL FIELD

The present disclosure relates generally to wager-based gaming machines, and more specifically to ticket-based trial account or log-in systems for use in wager-based gaming systems.

BACKGROUND

Entities offering wager gaming may provide various incentives to induce players to engage in continued or increased revenue-generating game play. For example, player tracking systems may offer players rewards based on their game play. Such tracking systems rely on the player having a player tracking account with which they are associated.

SUMMARY

In some implementations, a wager gaming method is provided, the method including: receiving input from indicating a first player tracking account; receiving input authenticating the first player tracking account, the input authenticating the first player tracking account different from the input indicating the first player tracking account; providing a first level of access to the first player tracking account after the input indicating the first player tracking account and the input authenticating the first player tracking account are received; receiving, while the first level of access is provided, input indicating a request for a first temporary ID associated with the first player tracking account; issuing the first temporary ID; receiving input indicating the first temporary ID; providing, without requiring authentication of the first player tracking account and responsive to the input indicating the first temporary ID, a second level of access to the first player tracking account, wherein the second level of access is less than the first level of access.

In some wager gaming method implementations, the first level of access: permits accrual of points or awards to the first player tracking account, permits the issuance of temporary IDs, including the first temporary ID, permits the spending or redemption of points or awards from the first player tracking account, and permits access to personal data or authentication data of a first player associated with the first player tracking account, and the second level of access: permits the accrual of points or awards to the first player tracking account, does not permit the issuance of a secondary temporary ID, does not permit the spending or redemption of points or awards from the first player tracking account, and does not permit access to personal data or authentication data of the first player associated with the first player tracking account.

In some wager gaming method implementations, the method may further include offering, after the second level of access to the first player tracking account is provided, to open a second player tracking account associated with a player using the first temporary ID to which the player will have the first level of access.

In some wager gaming method implementations, the method may further include: receiving input indicating that the player accepts the offer; requesting account data sufficient to create the second player tracking account; receiving the account data sufficient to create the second player tracking account; creating the second player tracking account; and transferring points or awards accrued to the first player tracking account under the second level of access by the player to the second player tracking account.

In some wager gaming method implementations, the method may further include: receiving input indicating that the player accepts the offer; requesting account data sufficient to create the second player tracking account; receiving the account data sufficient to create the second player tracking account; creating the second player tracking account; and duplicating, in the second player tracking account, points or awards accrued to the first player tracking account under the second level of access by the player.

In some wager gaming method implementations, the method may further include: receiving input indicating that the player accepts the offer; requesting account data sufficient to create the second player tracking account; receiving the account data sufficient to create the second player tracking account; creating the second player tracking account; and providing points or an award to the first player tracking account.

In some wager gaming method implementations, the method may further include: disallowing all access to the first player tracking account under the first temporary ID after a predetermined period of time has elapsed; and offering to open a second player tracking account associated with a player using the first temporary ID to which the player will have the first level of access.

In some implementations, a gaming machine is provided, the gaming machine including an input device; a temporary ID reading device; a master gaming controller; a temporary ID issuance device; and a communications interface, wherein the input device, the temporary ID reading device; the communications interface, the temporary ID issuance device, and the master gaming controller are communicatively connected and configured to: receive input indicating a temporary ID via the temporary ID reading device, wherein the temporary ID may be associated with a first player tracking account and may have been created in response to a request made while the first player tracking account was accessed using a first level of access; and provide, without requiring authentication of a first player tracking account and responsive to receiving the input indicating the temporary ID, a second level of access to the first player tracking account, wherein the second level of access may be less than a first level of access.

In some gaming machine implementations, the first level of access: permits accrual of points or awards to the first player tracking account, permits the issuance of temporary IDs, including the temporary ID, permits the spending or redemption of points or awards from the first player tracking account, and permits access to personal data or authentication data of a first player associated with the first player tracking account, and the second level of access: permits the accrual of points or awards to the first player tracking account, does not permit the issuance of a secondary temporary ID, does not permit the spending or redemption of points or awards from the first player tracking account, and does not permit access to personal data or authentication data of the first player associated with the first player tracking account.

In some gaming machine implementations, the input device, the temporary ID reading device, the communications interface, the temporary ID issuance device, and the master gaming controller may be further configured to offer to open a second player tracking account associated with a player using the temporary ID to which the player will have the first level of access.

In some gaming machine implementations, the input device, the temporary ID reading device, the communications interface, the temporary ID issuance device, and the master gaming controller may be further configured to: receive input via the input device indicating that the offer is accepted;

request account data sufficient to create the second player tracking account; and transmit the account data to a player tracking server.

In some gaming machine implementations, the input device, the temporary ID reading device, the communications interface, the temporary ID issuance device, and the master gaming controller may be further configured to: disallow all access to the first player tracking account under the temporary ID after a predetermined period of time has elapsed; and offer to open a second player tracking account associated with a player using the temporary ID to which the player will have the first level of access.

In some implementations, a wager gaming system is provided, the system including an input device; a temporary ID issuance device; a temporary ID reading device; and a player tracking server, wherein the input device, the temporary ID issuance device, the temporary ID reading device, and the player tracking server are communicatively connected and configured to: receive input indicating a first player tracking account; receive input authenticating the first player tracking account, the input authenticating the first player tracking account different from the input indicating the first player tracking account; provide a first level of access to the first player tracking account after the input indicating the first player tracking account and the input authenticating the first player tracking account are received; receive, while the first level of access is provided, input via the input device indicating a request for a first temporary ID associated with the first player tracking account; issue the first temporary ID using the temporary ID issuance device; receive input indicating the first temporary ID via the temporary ID reading device; provide, without requiring authentication of the first player tracking account and responsive to receiving the input indicating the first temporary ID, a second level of access to the first player tracking account, wherein the second level of access is less than the first level of access.

In some wager gaming system implementations, the first level of access: permits accrual of points or awards to the first player tracking account, permits the issuance of temporary IDs, including the first temporary ID, permits the spending or redemption of points or awards from the first player tracking account, and permits access to personal data or authentication data of a first player associated with the first player tracking account, and the second level of access: permits the accrual of points or awards to the first player tracking account, does not permit the issuance of a secondary temporary ID, does not permit the spending or redemption of points or awards from the first player tracking account, and does not permit access to personal data or authentication data of the first player associated with the first player tracking account.

In some wager gaming system implementations, the input device, the temporary ID issuance device, the temporary ID reading device, and the player tracking server may be further configured to: offer, after the second level of access to the first player tracking account is provided, to open a second player tracking account associated with a player using the first temporary ID to which the player will have the first level of access.

In some wager gaming system implementations, the input device, the temporary ID issuance device, the temporary ID reading device, and the player tracking server may be further configured to: receive input indicating that the player accepts the offer; request account data sufficient to create the second player tracking account; receive the account data sufficient to create the second player tracking account; create the second player tracking account; and transfer points or awards accrued to the first player tracking account under the second level of access by the player to the second player tracking account.

In some wager gaming system implementations, the input device, the temporary ID issuance device, the temporary ID reading device, and the player tracking server may be further configured to receive input indicating that the player accepts the offer; request account data sufficient to create the second player tracking account; receive the account data sufficient to create the second player tracking account; create the second player tracking account; and duplicate, in the second player tracking account, points or awards accrued to the first player tracking account under the second level of access by the player.

In some wager gaming system implementations, the input device, the temporary ID issuance device, the temporary ID reading device, and the player tracking server may be further configured to receive input indicating that the player accepts the offer; request account data sufficient to create the second player tracking account; receive the account data sufficient to create the second player tracking account; create the second player tracking account; and provide points or an award to the first player tracking account.

In some wager gaming system implementations, the input device, the temporary ID issuance device, the temporary ID reading device, and the player tracking server may be further configured to disallow all access to the first player tracking account under the first temporary ID after a predetermined period of time has elapsed; and offer to open a second player tracking account associated with a player using the first temporary ID to which the player will have the first level of access.

In some implementations, a temporary ID is provided, the temporary ID comprising an identification code associated with a first player tracking account, wherein the identification code, when supplied to a gaming machine, allows a holder of the temporary ID to access the first player tracking account at a restricted level of access, the restricted level of access less than a level of access provided in response to providing a player tracking account code and an authentication code for the first player tracking account.

BRIEF DESCRIPTION OF THE DRAWINGS

The included drawings are for illustrative purposes and serve only to provide examples of possible structures and process steps for the disclosed inventive systems, methods, and apparatuses for providing ticket-based trial account or log-in systems for wagering game play. These drawings in no way limit any changes in form and detail that may be made to implementations by one skilled in the art without departing from the spirit and scope of the disclosure.

DETAILED DESCRIPTION

Although the following text sets forth a detailed description of numerous different embodiments, it should be understood that the legal scope of the invention is defined by the words of the claims set forth at the end of this patent. The detailed description is to be construed as an example only and does not describe every possible embodiment since describing every possible embodiment would be impractical, if not impossible. Numerous alternative embodiments may be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1A:
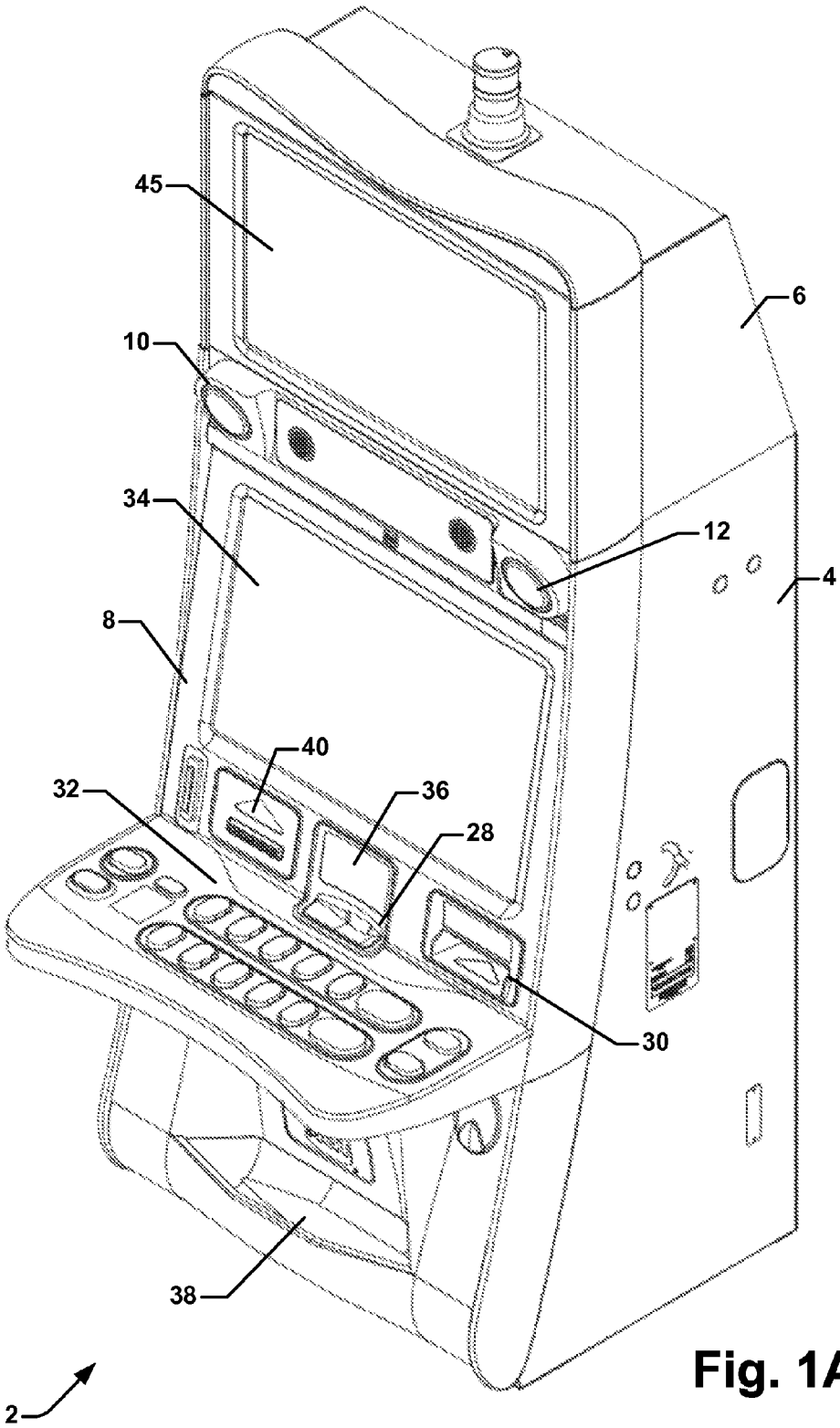
FIGS. 1A-1C depict isometric, front, and side views, respectively, of a wagering game machine which may be used to provide some of the techniques described below.
Figure 1B:
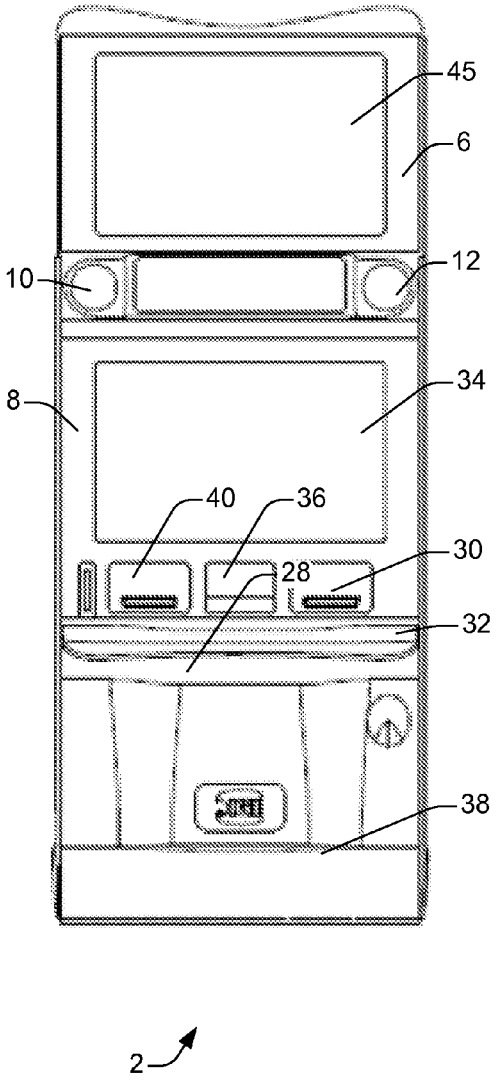
Figure 1C:
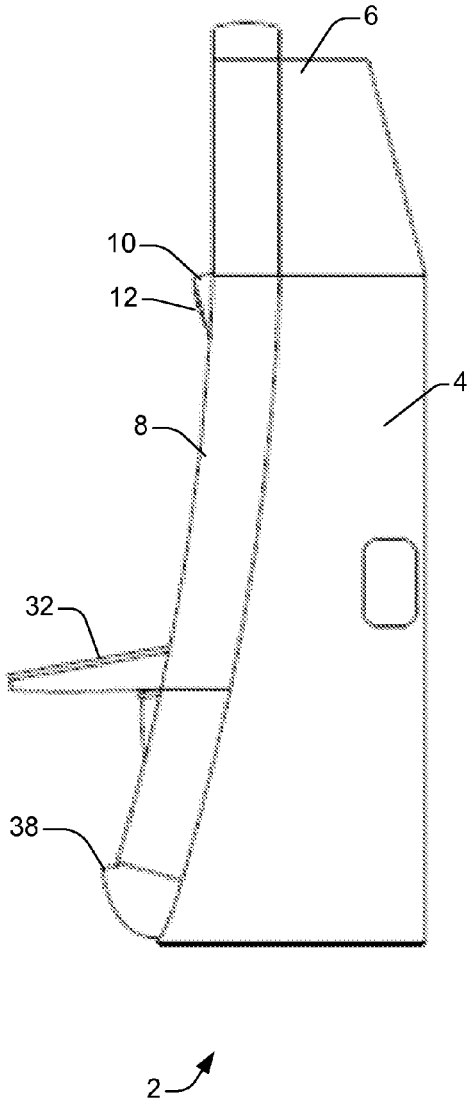

FIGS. 1A, 1B, and 1C show isometric, front, and side views, respectively, of a gaming machine 2, configured in accordance with one implementation. As illustrated in FIGS. 1A-1C, gaming machine 2 includes a main cabinet 4, which generally surrounds the machine interior and is viewable by users. The main cabinet includes a main door 8 on the front of the machine, which opens to provide access to the interior of the machine.

In some implementations, the electronic gaming machine may include any of a plurality of devices. For example, the electronic gaming machine may include a ticket printer that prints bar-coded tickets, such as some temporary IDs as described further below, a key pad for entering player tracking information, a display (e.g., a video display screen) for displaying player tracking information, a card reader 40 for entering a magnetic stripe card containing player tracking information, and various other devices. The ticket printer may be used to print tickets for a cashless ticketing system or for a ticket-based trial account or log-in system. In FIGS. 1A-1C, attached to the main door is a payment acceptor 28, a bill validator 30, and a coin tray 38. The payment acceptor may include a coin slot and/or a payment, note, or bill acceptor, where the player inserts money, coins, tokens, or other types of payments.

In some implementations, devices such as readers or validators for credit cards, debit cards, smart cards, or credit slips may facilitate payment or ticket-based trial account or log-in functionality. For example, a player may insert an identification card into a card reader 40 of the gaming machine. The identification card may be a smart card coded with a player's identification, credit totals (or related data) and other relevant information. As another example, a player may carry a portable device, such as a cell phone, a radio frequency identification tag or any other suitable wireless device. The portable device may communicates a player's identification, credit totals (or related data), and/or any other relevant information to the gaming machine. As yet another example, money may be transferred to a gaming machine through electronic funds transfer. When a player funds the gaming machine, a another logic device coupled to the gaming machine may determine the amount of funds entered and display the corresponding amount on a display device.

In some implementations, attached to the main door are a plurality of player-input switches or buttons 32. The input switches can include any suitable devices which enable the player to produce an input signal which is received by the processor. The input switches may include a game activation device that may be used by the player to start any primary game or sequence of events in the gaming machine. The game activation device can be any suitable play activator such as a "bet one" button, a "max bet" button, or a "repeat the bet" button. In some instances, upon appropriate funding, the gaming machine may begin the game play automatically. Alternately, the gaming machine may automatically activate game play after detecting user input via the game activation device.

In some implementations, one input switch is a cash-out button. The player may push the cash-out button and cash out to receive a cash payment or other suitable form of payment corresponding to the number of remaining credits. For example, when the player cashes out, the player may receive the coins or tokens in a coin payout tray. As another example, the player may receive other payout mechanisms such as tickets or credit slips redeemable by a cashier (or other suitable redemption system) or funding to the player's electronically recordable identification card. As yet another example, funds may be transferred from the gaming machine to the player's smart card.

In some implementations, one input switch is a touch-screen coupled with a touch-screen controller, or some other touch-sensitive display overlay to enable for player interaction with the images on the display. The touch-screen and the touch-screen controller may be connected to a video controller. A player may make decisions and input signals into the gaming machine by touching the touch-screen at the appropriate places. One such input switch is a touch-screen button panel.

In some implementations, the gaming machine may include communication ports for enabling communication of the gaming machine processor with external peripherals, such as external video sources, expansion buses, game or other displays, a SCSI port, a key pad, or a network interface for communicating via a network.

In some implementations, the gaming machine may include a label area, such as the label area 36. The label area may be used to display any information or insignia related to activities conducted at the gaming machine.

In some implementations, the electronic gaming machine may include one or more display devices. For example, the electronic gaming machine 2 includes display devices 34 and 45. The display devices 34 and 45 may each include any of a cathode ray tube, an LCD, a light emitting diode (LED) based display, an organic light emitting diode (OLED) based display, a polymer light emitting diode (PLED) based display, an SED based-display, an E-ink display, a plasma display, a television display, a display including a projected and/or reflected image, or any other suitable electronic display device.

In some implementations, the display devices at the gaming machine may include one or more electromechanical devices such as one or more rotatable wheels, reels, or dice. The display device may include an electromechanical device adjacent to a video display, such as a video display positioned in front of a mechanical reel. The display devices may include dual-layered or multi-layered electromechanical and/or video displays that cooperate to generate one or more images. The display devices may include a mobile display device, such as a smart phone or tablet computer, that allows play of at least a portion of the primary or secondary game at a location remote from the gaming machine. The display devices may be of any suitable size and configuration, such as a square, a rectangle, an elongated rectangle, or a display with a curved edge.

In some implementations, the display devices of the gaming machine are configured to display game images or other suitable images. The images may include symbols, game indicia, people, characters, places, things, faces of cards, dice, and any other images. The images may include a visual representation or exhibition of the movement of objects such as mechanical, virtual, or video reels and wheel. The images may include a visual representation or exhibition of dynamic lighting, video images, or any other images.

In some implementations, the electronic gaming machine may include a top box. For example, the gaming machine 2 includes a top box 6, which sits on top of the main cabinet 4. The top box 6 may house any of a number of devices, which may be used to add features to a game being played on the gaming machine 2. These devices may include speakers 10 and 12, display device 45, and any other devices. Further, the top box 6 may house different or additional devices not illustrated in FIGS. 1-2B. For example, the top box may include a bonus wheel or a back-lit silk screened panel which may be used to add bonus features to the game being played on the gaming machine. As another example, the top box may include a display for a progressive jackpot offered on the gaming machine. As yet another example, the top box may include a smart card interaction device. During a game, these devices are controlled and powered, at least in part, by circuitry (e.g. a master gaming controller) housed within the main cabinet 4 of the machine 2.

In some implementations, speakers may be mounted and situated in the cabinet with an angled orientation toward the player. For instance, the speakers 10 and 12 located in top box area 6 of the upper region of gaming machine 2 may be mounted and situated in the cabinet with an angled orientation down towards the player and the floor. In one example, the angle is 45 degrees with respect to the vertical, longitudinal axis of machine 2. In another example, the angle is in a range of 30-60 degrees. In another example, the angle is any angle between 0 and 90 degrees. In some implementations, the angle of speakers in the gaming machine may be adjustable. For instance, speakers may be adjusted to face in a direction more closely approximating an estimated position of a player's head or facial features.

The bill validator 30, player-input switches 32, display screen 34, and other gaming devices may be used to present a game on the game machine 2. The devices may be controlled by code executed by a master gaming controller housed inside the main cabinet 4 of the machine 2. The master gaming controller may include one or more processors including general purpose and specialized processors, such as graphics cards, and one or more memory devices including volatile and non-volatile memory. The master gaming controller may periodically configure and/or authenticate the code executed on the gaming machine.

In some implementations, the gaming machine may include a sound generating device coupled to one or more sounds cards. The sound generating device may include one or more speakers or other sound generating hardware and/or software for generating sounds, such as playing music for the primary and/or secondary game or for other modes of the gaming machine, such as an attract mode. The gaming machine may provide dynamic sounds coupled with attractive multimedia images displayed on one or more of the display devices to provide an audio-visual representation or to otherwise display full-motion video with sound to attract players to the gaming machine. During idle periods, the gaming machine may display a sequence of audio and/or visual attraction messages to attract potential players to the gaming machine. The videos may also be customized for or to provide any appropriate information.

In some implementations, the gaming machine may include a sensor, such as a camera that is selectively positioned to acquire an image of a player actively using the gaming machine and/or the surrounding area of the gaming machine. The sensor may be configured to capture biometric data about a player in proximity to the gaming machine. The biometric data may be used to implement mechanical and/or digital adjustments to the gaming machine. Alternately, or additionally, the sensor may be configured to selectively acquire still or moving (e.g., video) images. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol, animated avatar, or game indicia. In some implementations, the sensor may be used to trigger an attract mode effect. For example, when the sensor detects the presence of a nearby player, the gaming machine may play sound effects or display images, text, graphics, lighting effects, or animations to attract the player to play a game at the gaming machine.

Gaming machine 2 is but one example from a wide range of gaming machine designs on which techniques for ticket-based trial accounts or log-in as described herein may be implemented. For example, not all suitable gaming machines have top boxes or player tracking features. Further, some gaming machines have only a single game display—mechanical or video, while others may have multiple displays.

All of the following methods and processes, along with other methods and processes of the present invention, may be implemented by software, firmware and/or hardware. For example, the methods of the present invention may be implemented by computer programs embodied in machine-readable media. The invention may be implemented by networked gaming machines, game servers and/or other such devices. Those of skill in the art will appreciate that the steps of the methods described herein are not necessarily performed (and in some implementations are not performed) in the order shown. Moreover, some implementations of the methods described herein may include more or fewer steps than those shown and/or described.

Figure 2:
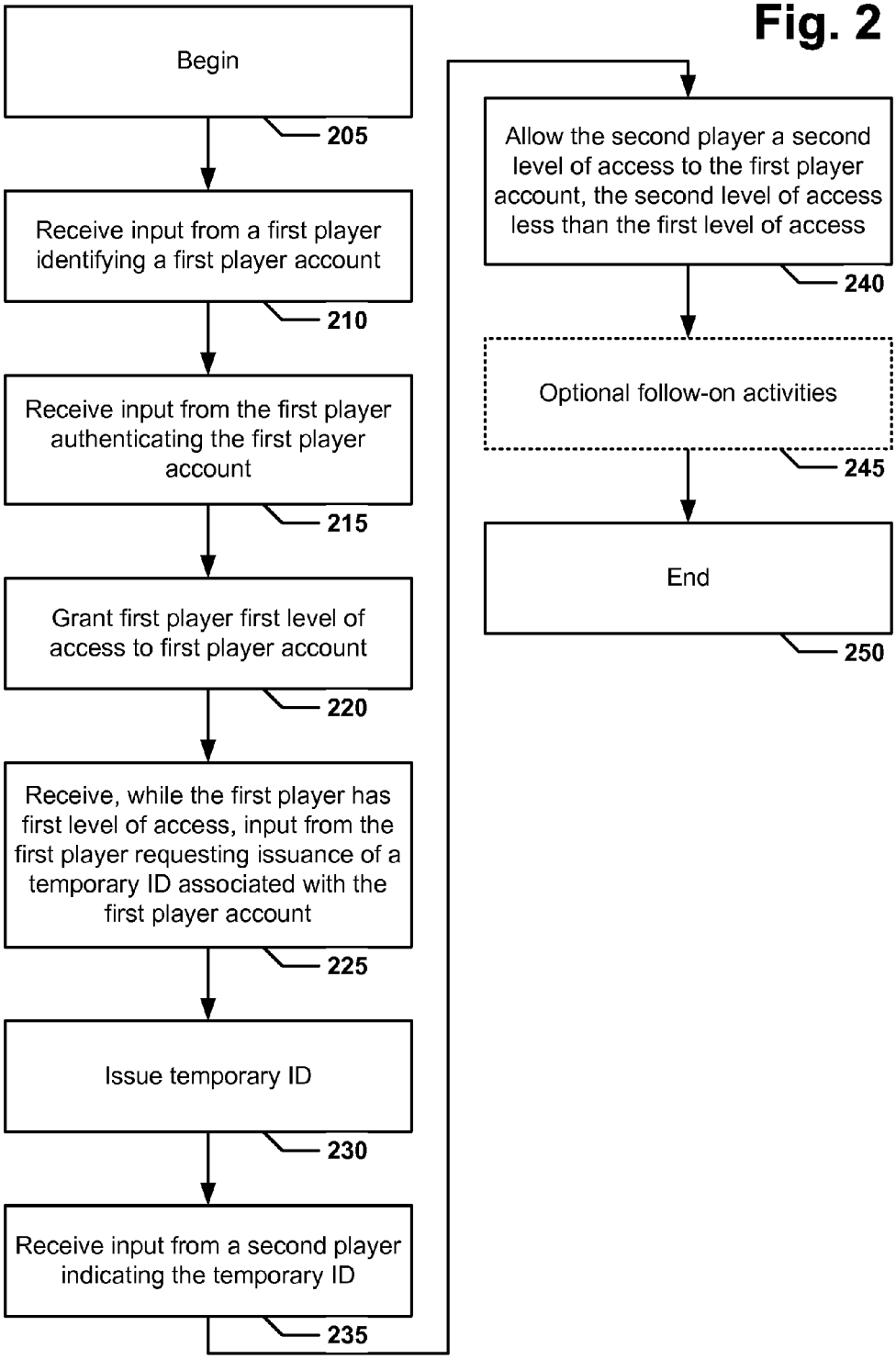
FIG. 2 depicts a flow diagram for one implementation of a ticket-based trial account or log-in technique according to the present disclosure.

In one implementation, as diagrammed at a high level in FIG. 2, a ticket-based trial account or log-in process may begin (205) with a first player accessing a gaming machine, kiosk, or other device which is in communication with a player tracking system. The first player may input information which identifies a first player tracking account associated with the first player (210) via the gaming machine, kiosk, or other device. The player tracking account identification information may be input manually via a keypad or on-screen keypad, read from a magnetic or RFID-equipped card, obtained from biometric signature data taken from the player, or obtained through using any other suitable technology. The first player may also input authentication information (215) via the gaming machine, kiosk, or other device, such as a password, passcode, biometric signature, or other suitable authentication protocol. In some implementations, the player tracking account identification and authentication protocol may be satisfied by the same input, e.g., a fingerprint scan may serve to both identify the first player tracking account associated with that fingerprint and may also authenticate the first player as the owner of the first player tracking account.

Account identification information may, in general, identify a particular player tracking account, e.g., by player tracking account number or other identifier. Authentication information may, in general, indicate to a player tracking server that the provider of the authentication information is authorized to access a player tracking account associated with the authentication information, e.g., a fingerprint or password.

After the first player has provided the required input identifying and authenticating the first player tracking account, the first player may be granted a first level of access to the first player tracking account (220). While the first player has the first level of access to the first player tracking account, the first player may request that the gaming machine, kiosk, or other device issue a temporary ID associated with the first player account (225). Upon receiving the request, the gaming machine, kiosk, or other device may then issue the temporary ID (230). The temporary ID may be given to a second player by the first player, although the first player could also use the temporary ID in the manner which follows.

In some implementations, the number of temporary IDs which may be issued from a player tracking account may be limited. For example, the number of temporary IDs which may be issued from a single player tracking account may be limited to 3 temporary IDs at any one time, or only one temporary ID may be issued per week. In some embodiments, the limit for a player tracking account may be increased based on whether past temporary IDs issued from that account have been converted into new player tracking accounts. It may be desirable to encourage the owner of such a "high-performing" player tracking account to encourage even more friends to join the player tracking system by allowing for greater numbers of temporary IDs to be issued. In some implementations, the number of allowed temporary IDs for a player tracking account may be based on the account owner's "rank"—higher ranked players may have more desirable player tracking accounts, and it may be desirable to increase the number of temporary IDs in circulation which are tied to a more desirable account than to a less desirable account. In some implementations, there may also be a lifetime limit on the number of temporary IDs which may be issued.

After the temporary ID has been issued, it may be used to log in to gaming machines, kiosks, or other devices and access the first player tracking account at a second access level. For example, a second player may have received the temporary ID from the first player and may provide it to a gaming machine. The gaming machine may receive the temporary ID (235) from the second player and enable a second level of access to the first player tracking account associated with the first player (240). The second level of access to the first player tracking account via the temporary ID does not require the input of authentication information as required for the first level of access. The level of access to the first player tracking account which may be obtained by providing the temporary ID is less than the level of access which may be obtained by providing the account identification and authentication information.

Optional follow-on activities may ensue after the issuance or use of a temporary ID associated with the first player tracking account (245). The temporary ID may also, in some implementations, be used multiple times before the ticket-based log-in process ends (250).

Figure 5:
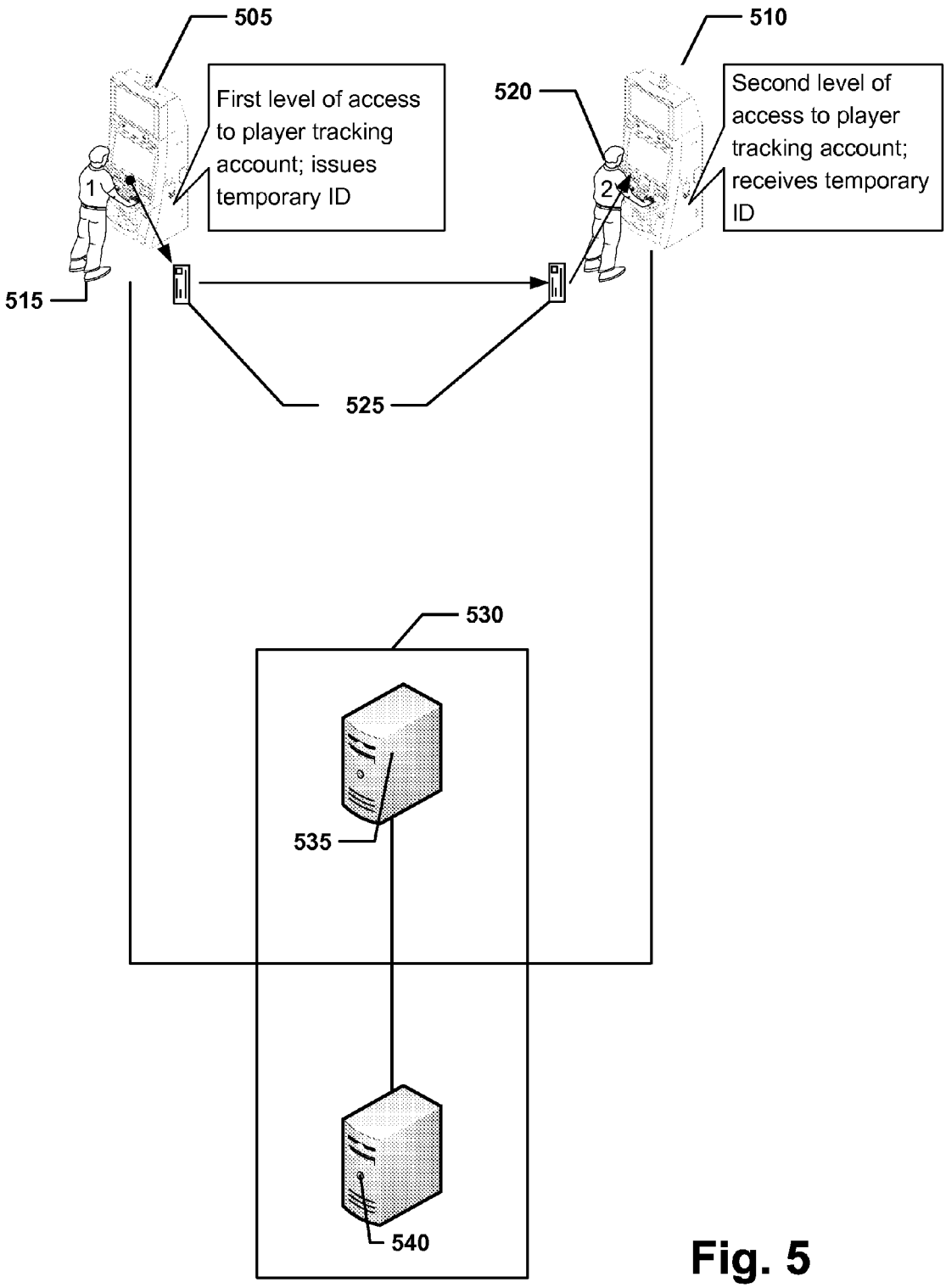
FIG. 5 depicts a high-level conceptual diagram of one implementation of a system which may be used to implement the techniques described herein.

The technique of FIG. 2 may be performed, in one implementation, by a system similar to that shown in FIG. 5. First player 515 may log into first gaming machine 505 by supplying account identification information and account authentication information to first gaming machine 505. First gaming machine 505 may communicate the account identification information and the account authentication information to player tracking account server 535 at remote site 530. Player tracking account server 535 may compare the account identification information and the account authentication information against records in a player tracking account database. If player tracking account server 535 verifies the account identification information and the account authentication information, player tracking account server 535 may communicate with first gaming machine 505 and indicate that the first level of access is to be granted to first player 515. First gaming machine 505 may then provide first player 515 the first level of access to the player tracking account or provide a link to player tracking server 535, which may provide the first level of access to the player tracking account. First player 515 may then request that first gaming machine 505 generate temporary ID 525, which first gaming machine 505 may issue, for example, via a printer, card dispenser, or other temporary ID issuance device. First player 515 may then, for example, give temporary ID 525 to second player 520, who may carry temporary ID 525 to second gaming machine 510. After presenting temporary ID 525 to second gaming machine 510, second gaming machine 510 may retrieve temporary ID information from temporary ID 525 and send the temporary ID information to player tracking account server 535. Player tracking account server 535 may process the temporary ID information and determined that second player 520 is to only be allowed the second level of access to the player tracking account. Player tracking account server 535 may then communicate with gaming machine 510 and indicate that second player 520 is to be given only the second level of access to the player tracking account. Second player 520 may then provide second player 520 the second level of access to the player tracking account or provide a link to player tracking server 535, which may provide the second level of access to the player tracking account.

Figure 3:
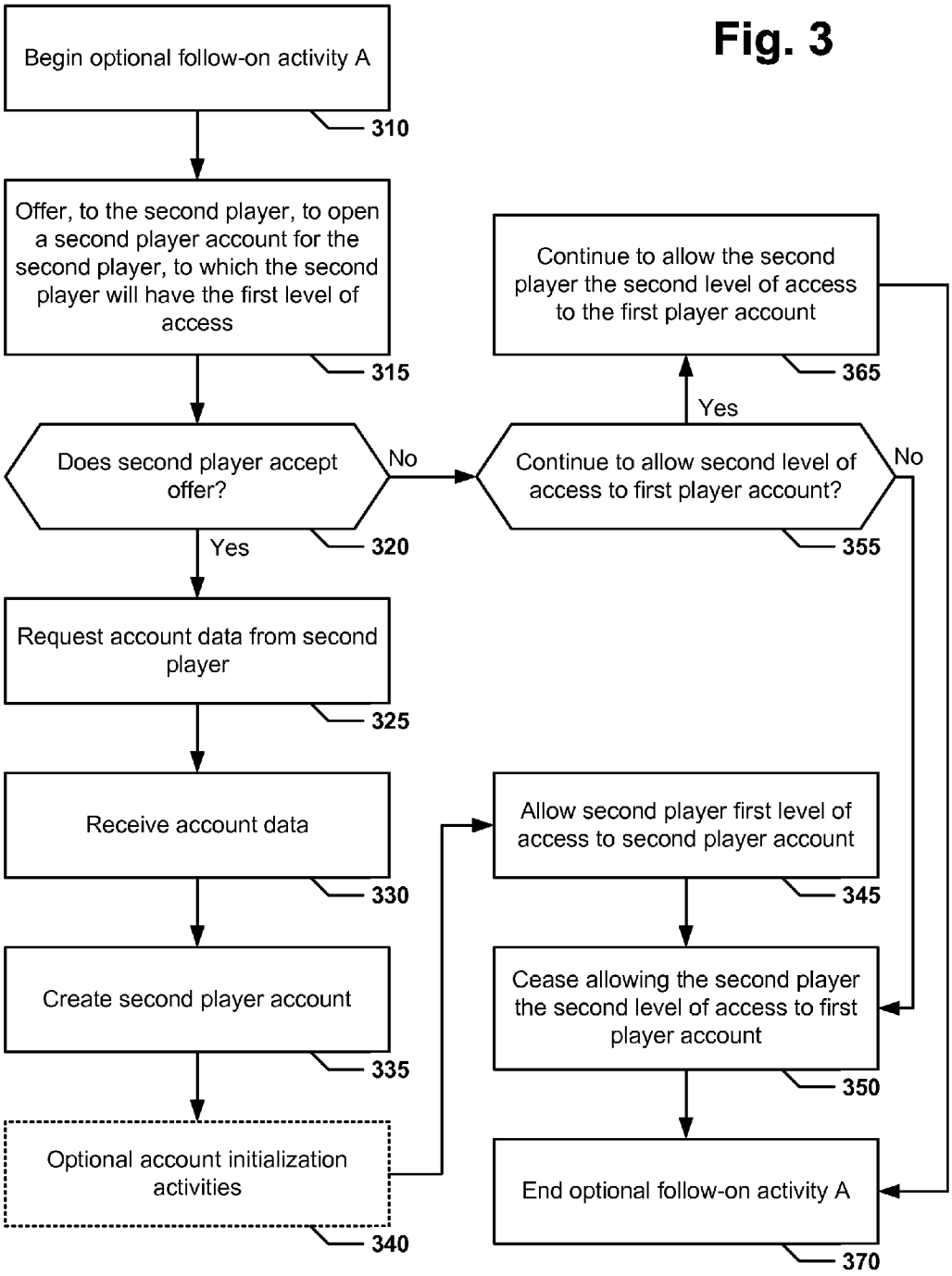
FIG. 3 depicts a flow diagram for one implementation of a follow-on activity to a ticket-based trial account or log-in technique according to the present disclosure.

In some implementations, such as that depicted at a high level in FIG. 3, an optional follow-on activity (310) may include offering to open a second player account for the person who is logged in using the temporary ID, e.g., the second player. A person accepting such an offer (320) will be granted a second player account to which they will have the first level of access. Upon accepting the offer, a request may be made of the person accepting the offer for the input of data necessary to open the second player tracking account (325). Upon input, such account data may be received by a player tracking system (330), which may then create the second player tracking account (335). Various optional account initialization activities may take place in association with the creation of the second player tracking account (340). The person opening the second player tracking account, e.g., the second player, may be granted the first level of access to the second player tracking account (345). At some point, the temporary ID may be deactivated to prevent further log-ins to the first player tracking account using the temporary ID, thereby, for example, halting the second player's second level of access to the first player tracking account (350).

If the person does not accept the offer (320), a decision may be made (355) as to whether the second level of access to the first player tracking account should continue to be allowed. If further second-level access is warranted, the person refusing the offer may nonetheless continue to be offered the second level of access to the first player tracking account for at least some additional period of time (365). If no further second-level access is to be allowed, the temporary ID may be deactivated (350). The optional follow-on activity may then end (370).

Figure 4:
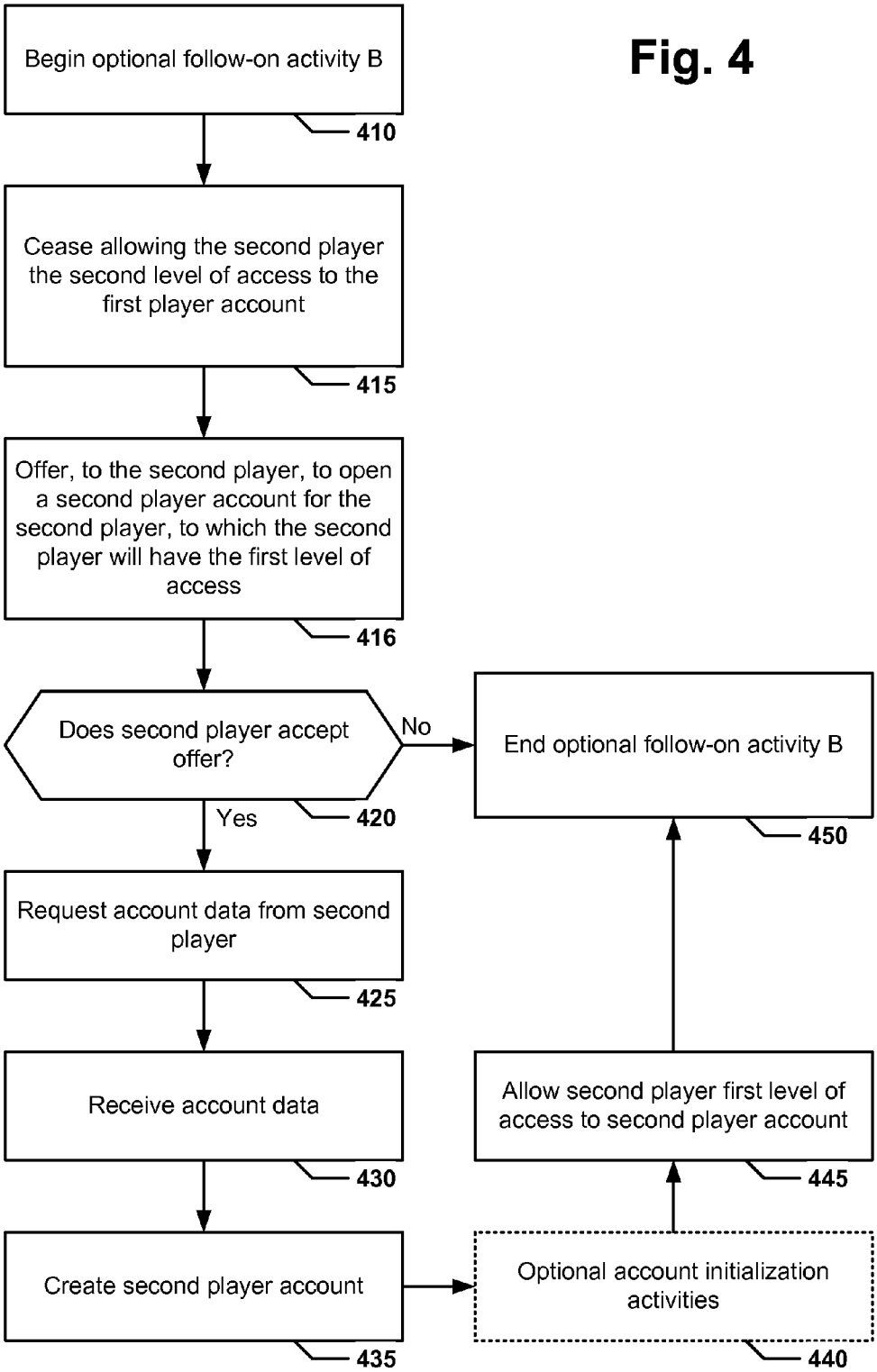
FIG. 4 depicts a flow diagram for another implementation of a follow-on activity to a ticket-based trial account or log-in technique according to the present disclosure.

FIG. 4 diagrams, at a high level, a different follow-on activity (410) which may involve allowing a person the second level of access to the first player tracking account for a limited period of time and then disabling the second level of access to the first player tracking account (415). After disabling the second level of access to the first player tracking account, the person previously using the second level of access to the first player tracking account may be offered a chance to open a second player tracking account (416). If the person does not accept the offer (420), the follow-on activity ends (450). If the person does accept the offer (420), account data may be requested from the person to open the second player tracking account (425). After the account data is received (430), the second player tracking account may be created (435). Various optional account initialization activities may take place in association with the creation of the second player tracking account (440). The person opening the second player tracking account, e.g., the second player, may be granted the first level of access to the second player tracking account (445), and the follow-on activity may end (450).

Some implementations of follow-on activities of FIGS. 4 and 3 may be implemented using, for example, a system such as that shown in FIG. 5. For example, second player 520 may be offered an opportunity to create their own player tracking account after a predetermined period of time. Such an offer may be made, for example, via a display associated with second gaming machine 510. Second player 520 may accept such an offer via an input device on second gaming machine 510, and may enter account creation data via the input device. Second gaming machine 510 may transmit the account creation data to account creation server 540, which may process the account creation data and transmit a request for a new account to be created to player tracking account server 535. After confirming with player tracking account server 535 that the new player tracking account has been created, account creation server 540 may instruct second gaming machine 510 to inform second player 520 that the player tracking account has been created for them. In one implementation, account creation server 540 may simply instruct second gaming machine 510 to provide the first level of access to the new player tracking account to second player 520 using second gaming machine 510.

Figure 6:
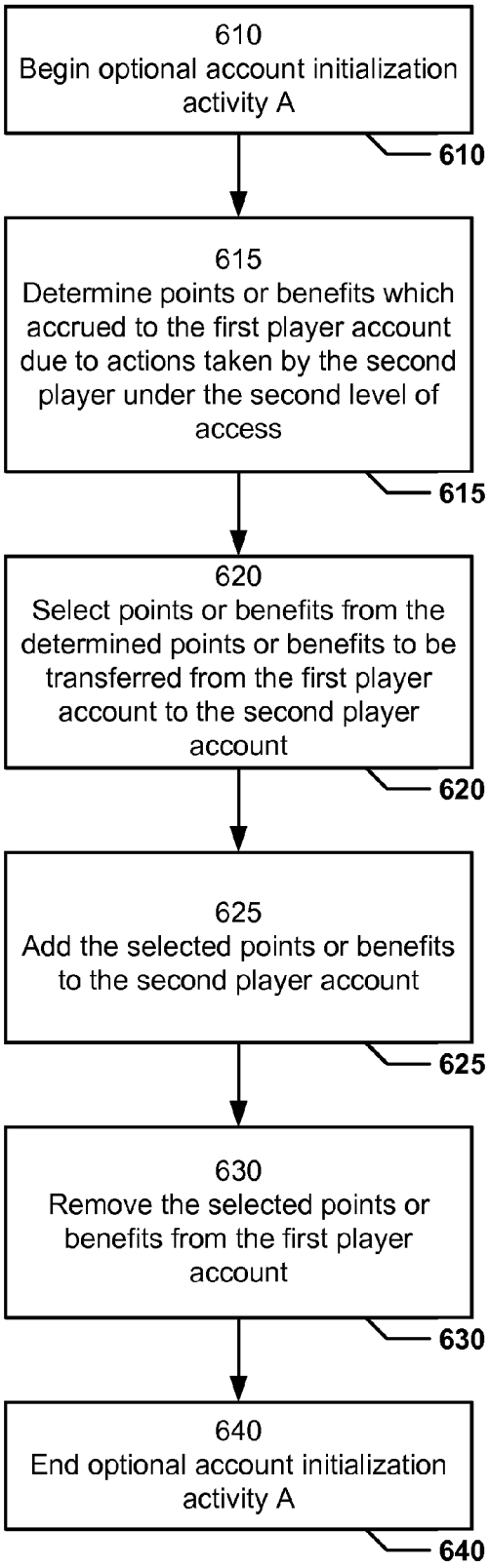
FIG. 6 depicts a flow diagram for an implementation of an account initialization activity for a ticket-based trial account or log-in technique according to the present disclosure.

In some implementations, such as that diagrammed in FIG. 6, optional account initialization activities may be performed in conjunction with the creation of the second player tracking account. In one such implementation (610), a determination may be made as to whether any player tracking points and/or benefits accrued to the first player tracking account due to actions taken by a person while the person is logged in to the first player tracking account under the second level of access (615). Tracking points and/or benefits may be selected from the determined tracking points and benefits to be transferred to the second player tracking account (620). The selected tracking points and/or benefits may then be added to the second player tracking account (625) and removed from the first player tracking account (630). The person opening the second player tracking account may thus retain some or all of the benefits which their activity while logged in under the second level of access to the first player tracking account earned. The optional account initialization activity may then end (640).

Figure 7:
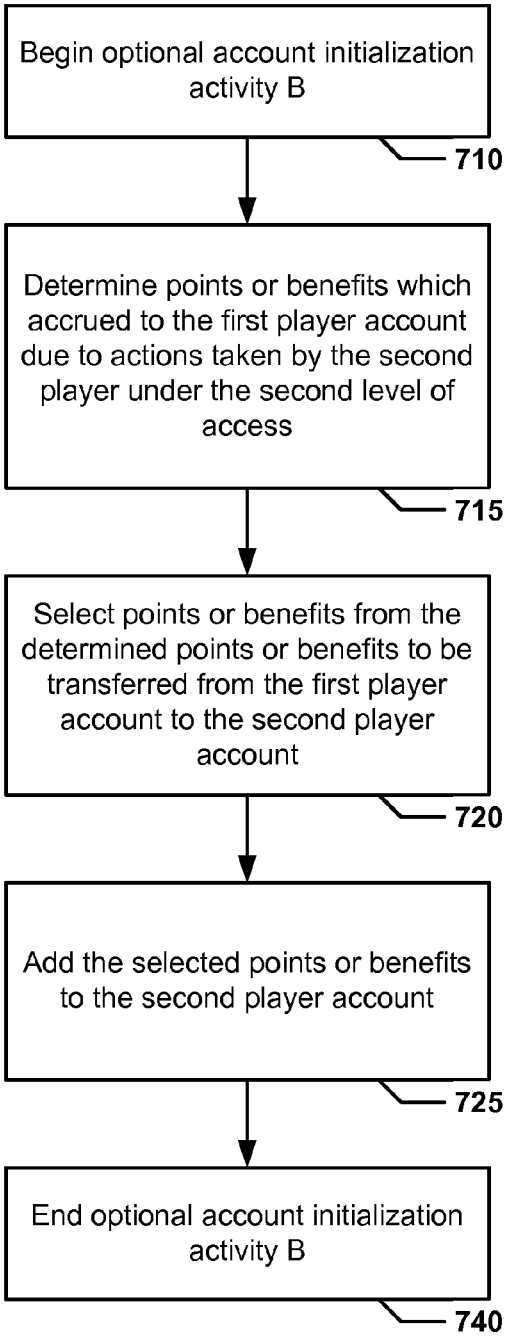
FIG. 7 depicts a flow diagram for another implementation of an account initialization activity for a ticket-based trial account or log-in technique according to the present disclosure.

FIG. 7 diagrams another implementation of such account initialization activity (710) in which a determination may be made as to whether any player tracking points and/or benefits accrued to the first player tracking account due to actions taken by a person while the person is logged in to the first player tracking account under the second level of access (715). Tracking points and/or benefits may be selected from the determined tracking points and benefits to be transferred to the second player tracking account (720). The selected tracking points and/or benefits may then be added to the second player tracking account (725). The person opening the second player tracking account may thus retain some or all of the benefits which their activity while logged in under the second level of access to the first player tracking account earned. The first player tracking account also retains the benefits obtained by the person using the second level of access. The optional account initialization activity may then end (640). As with the techniques of FIGS. 3 and 4, the techniques of FIGS. 6 and 7 may be implemented, in one implementation, on a system such as that shown in FIG. 5.

When a new player tracking account is opened in connection with a temporary ID, some implementations may reward the player who issued the temporary ID. For example, the first player tracking account, from which the temporary ID may have been issued, may be credited with extra benefits, status, or other rewards. In some embodiments, the owner of the first player tracking account may be offered various gifts, free play credits, in-game power-ups, or services in recognition of their assistance in bringing another member to the player tracking system. Such rewards may be random, fixed, or awarded on a sliding scale where the rewards increase in value the more players sign up for player tracking accounts based on temporary IDs issued from the player's player tracking account.

The temporary ID which is issued from the first player account may take a variety of forms. In some implementations, it may be a printed ticket which includes an identifier linking it to the first player account and other information defining the temporary ID. The other information defining the temporary ID may include one or more of: a lifespan of the temporary ID, an expiration date of the temporary ID, the name of a person for whom the temporary ID is intended, a web address for a website which allows a person to open a second player tracking account in association with the temporary ID, a machine-readable code, such as a bar or QR code, which may be used to convey the identifier to a gaming machine or other device via a temporary ID reading device, such as a bar code scanner, RFID reader, digital camera, magnetic stripe reader, etc. The temporary ID may be printed by gaming machine, kiosk, or by a printer attached or integrated with another device. The temporary ID may also be generated using other technologies, such as by coding a magnetic stripe card or by distributing pre-indexed RFID tags. The identifier linking the temporary ID to the first player tracking account may include, for example, the player tracking account number for the first player tracking account and a code identifying the temporary ID. The identifier may also, however, simply be a unique serial number which correlates with a data record in the player tracking system which identifies the first player tracking account.

Figure 8:
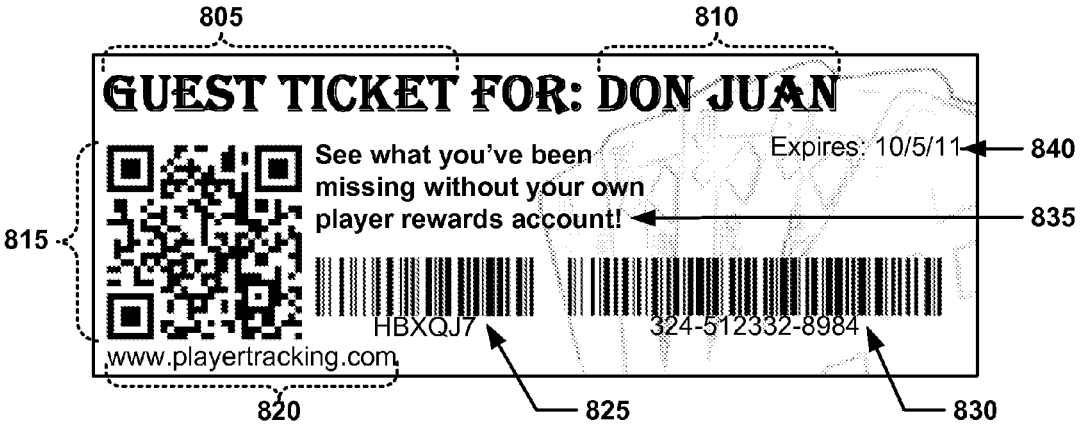
FIG. 8 depicts one implementation of a temporary ID according to the disclosure herein.

FIG. 8 shows one implementation of a temporary ID which shows some of the features discussed above. Temporary ID 800 includes message 805 identifying it as a temporary ID, a name 810 of the intended carrier of temporary ID 800, quick-recognition (QR) code 815 which, in this case, may contain an encoded uniform resource locator (URL) for a website which may, for example, allow the holder to learn more about player tracking accounts and even open their own player tracking account. While a QR code may be desirable to allow mobile devices to rapidly scan the URL and access the website, the URL may also be printed in human-readable text, such as with website address 820, to allow a person to simply type the address into a web browser. Advertising message 835 may include a suggestion that the player is missing out on a reward system by not having their own player tracking account, although the player tracking account may be referred to by a more enticing name, such as a "player rewards account." Temporary ID 800 may also include expiration date 840, which may let the person carrying temporary ID 800 know that they have only a limited period of time in which to use temporary ID 800. Temporary ID 800 may also include bar codes 825 and/or 830 indicating, for example, player tracking account information (830) and temporary ID information (825). The information of bar codes 825 and/or 830 may also, for example, be expressed using other machine-readable indicators, such as QR codes, or via human-readable text, such as is shown in the numbers below bar codes 825 and 830.

In some implementations, the temporary ID may include magnetic, RFID, or other machine-readable technology which may be used to provide the identifier to a gaming machine, kiosk, or other device using the machine-readable technology. For example, a magnetic swipe card may be used which includes the identified in the magnetic strip.

In some implementations, the temporary ID may be entirely virtual. For example, the temporary ID may simply consist of a unique username or ID number which may be entered by a person.

In some implementations, the temporary ID may be issued to a standalone electronic device, such as a cell phone, media player, smartphone, tablet, or other electronic device. In some such implementations, the temporary ID may take the form of an electronic image or document, such as a bar code or QR code, which may be displayed on-screen and scanned or read by the gaming machine, kiosk, or other device. In some other implementations, the temporary ID may be encoded, or additionally encoded, onto the electronic device and transmitted to the gaming machine, kiosk, or other device using a machine communication protocol, such as a wireless network connection, Bluetooth connection, near-field communication techniques, infrared, or even direct wired connection. In some implementations, the first person may specify a unique identifier associated with an electronic device, such as a serial number, when requesting the temporary ID. In such implementations, initiating communications with a gaming machine, kiosk, or other device using a device with the unique serial number may allow the player tracking system to reverse-look-up the serial number, retrieve the associated temporary ID, and provide the second level of access to the first player tracking account. In some implementations, the electronic device may have an application which is configured to communicate with a gaming machine, kiosk, or other device using a pre-determined communications protocol in order to use the temporary ID.

There may be several levels of access to a player tracking account. In general, the first level of access which is provided in response to the input of both account information and authentication information allows the first player to access portions of the first player tracking account which are not accessible using the second level of access. For example, the first level of access may allow a person with the first level of access to request the issuance of a temporary ID, whereas the second level of access does not. In another example, sensitive personal information, such as bank account data, social security numbers, credit card information, email addresses, phone numbers, account balances, and so on, may be visible or accessible under the first level of access, but not under the second level of access. Similarly, consumption of benefits associated with the first player tracking account may be permissible under the first level of access but not under the second level of access. There may also be other levels of access to the player tracking account which are not necessarily tied to temporary ID. For example, a player tracking account may have an administrative level of access which allows casino staff to review or access, but not change, data which is blocked from access under the second level of access.

While a person is logged into the first player tracking account under the second level of access, any player tracking points or benefits which are earned by the person may accrue to the first player tracking account, i.e., the first person can only benefit from the activities of the other person using the temporary ID, and the other person's activities cannot, in general, act to the first person's detriment.

Casinos, gaming establishments, or gaming websites using such a system may be able to attract new players to use their player tracking systems which they would otherwise not be able to attract. For example, some players may view player tracking systems as an annoyance or be loath to give out their personal data for use in the player tracking system. Some such players may recognize that there are even advantages to having a player tracking account, but have decided that such advantages do not outweigh the perceived disadvantages. Because the advantages cannot be fully experienced without a player tracking account, and because these players refuse to create a player tracking account, these players may never open a player tracking account. Using ticket-based log-in, however, allows another player with a player tracking account to create a temporary ID which the non-tracked player may use without the minor inconvenience of having to sign up for a player tracking account. The temporary ID allows the non-tracked player to experience the benefits of the player tracking system with no risk and little, if any, inconvenience, i.e., on a trial basis. Once the non-tracked player has experienced the benefits of the player tracking system for themselves, they may be much more likely to want to open their own player tracking account.

This allows casinos to leverage friendships and relationships between casino patrons in a way which benefits the casino. While a non-tracked player may be hesitant to trust advertising which touts the benefits of a player tracking account, the non-tracked player may be much more likely to trust the recommendation of a friend with a tracking account, which may lead to the friend giving the non-tracked player a temporary ID which will ultimately convince the non-tracked player that a player tracking account is worth signing up for.

The players may also benefit, as some player tracking systems may provide social features, such as player locator or messaging services, which enhance the gaming experience for both players.

In a variant of the ticket-based log-in techniques described above, a non-tracked player may also request a temporary ID from a gaming machine, kiosk, or other device directly. The device may then issue a temporary ID to the non-tracked player. This temporary ID may not be associated with any player tracking account at all, but may instead simply provide access to various benefits of a player tracking account, e.g., a trial account. In some implementations, a dummy player tracking account may be created which is associated with the temporary ID. In some further implementations, the dummy player tracking account may be modeled on an existing player tracking account. Such modeling may utilize data from an existing player tracking account but avoid including information which identifies the source of the account data. Regardless of how the dummy account is configured, the non-tracked player may log in to gaming machines using the temporary ID and experience game play using a player tracking account. After the non-tracked player has experienced tracked play using the temporary ID, the tracking system may offer to create an actual player tracking account for the non-tracked player, similar to the creation of the second player tracking account shown in FIGS. 3-7. The various player tracking points or other awards earned by the non-tracked player using the temporary ID may be transferred to the newly-created player tracking account.

Figure 9:
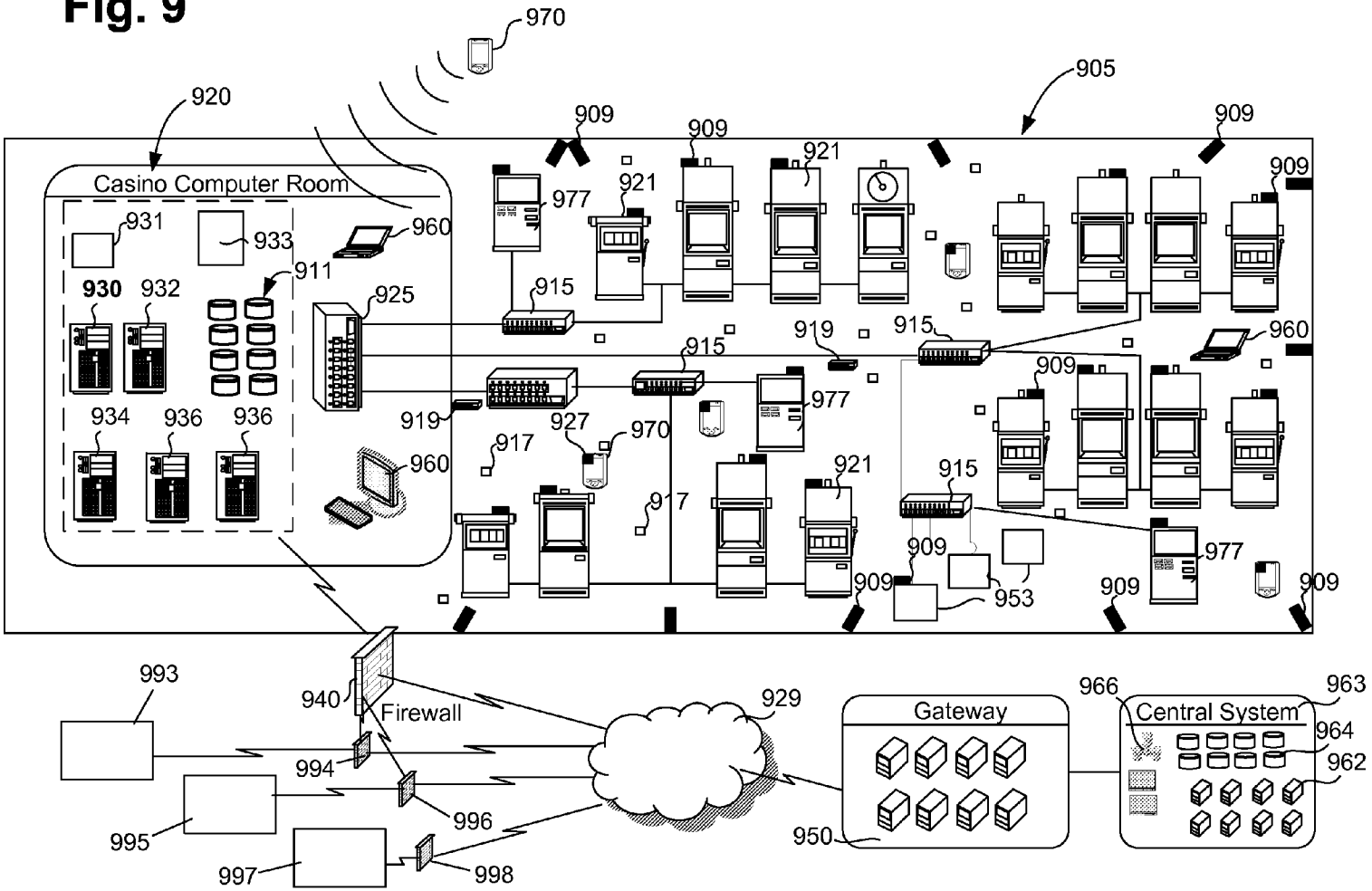
FIG. 9 depicts a high-level conceptual schematic of a wager gaming system which may be used to implement the techniques described herein.

FIG. 9 shows a server-based (Sb™) gaming network which may be used to implement some implementations described above. Those of skill in the art will realize that this architecture and the related functionality are merely examples and that the present disclosure encompasses many other such implementations and methods.

Here, casino computer room 920 and networked devices of a gaming establishment 905 are illustrated. Gaming establishment 905 is configured for communication with central system 963 via gateway 950. Gaming establishments 993 and 995 are also configured for communication with central system 963.

In some implementations, gaming establishments may be configured for communication with one another. In this example, gaming establishments 993 and 995 are configured for communication with casino computer room 920. Such a configuration may allow devices and/or operators in casino 905 to communicate with and/or control devices in other casinos. In some such implementations, a server in computer room 920 may control devices in casino 905 and devices in other gaming establishments. Conversely, devices and/or operators in another gaming establishment may communicate with and/or control devices in casino 905.

Here, gaming establishment 997 is configured for communication with central system 963, but is not configured for communication with other gaming establishments. Some gaming establishments (not shown) may not be in communication with other gaming establishments or with a central system. Gaming establishment 905 includes multiple gaming machines 921, each of which is part of a bank 910 of gaming machines 921. In this example, gaming establishment 905 also includes a bank of networked gaming tables 953. However, the present disclosure may be implemented in gaming establishments having any number of gaming machines, gaming tables, etc. It will be appreciated that many gaming establishments include hundreds or even thousands of gaming machines 921 and/or gaming tables 953, not all of which are necessarily included in a bank and some of which may not be connected to a network. At least some of gaming machines 921 and/or mobile devices 970 may be "thin clients" that are configured to perform client-side methods as described elsewhere herein. Gaming machines 921 may, for example, be configured to provide the first and second levels of access and issue and receive temporary IDs, much as gaming machines 505 and 510 are configured.

Some configurations can provide automated, multi-player roulette, blackjack, baccarat, and other table games. The table games may be conducted by a dealer and/or by using some form of automation, which may include an automated roulette wheel, an electronic representation of a dealer, etc. In some such implementations, devices such as cameras, radio frequency identification devices, etc., may be used to identify and/or track playing cards, chips, etc. Some of gaming tables 953 may be configured for communication with individual player terminals (not shown), which may be configured to accept bets, present an electronic representation of a dealer, indicate game outcomes, etc.

Gaming establishment 905 also includes networked kiosks 977. Depending on the implementation, kiosks 977 may be used for various purposes, including but not limited to cashing out, prize redemption, redeeming points from a player loyalty program, redeeming "cashless" indicia such as bonus tickets, smart cards, generating temporary IDs, creating new player tracking accounts based on temporary IDs, etc. In some implementations, kiosks 977 may be used for obtaining information about the gaming establishment, e.g., regarding scheduled events (such as tournaments, entertainment, etc.), regarding a patron's location, etc. Software related to such features may be provided and/or controlled, and related data may be obtained and/or provided, according to the present disclosure. For example, in some implementations of the disclosure, kiosks 977 may be configured to receive information from a patron, e.g., such as temporary ID information or account creation data.

In this example, each bank 910 has a corresponding switch 915, which may be a conventional bank switch in some implementations. Each switch 915 is configured for communication with one or more devices in computer room 920 via main network device 925, which combines switching and routing functionality in this example. Although various communication protocols may be used, some preferred implementations use the Gaming Standards Association's G2S Message Protocol. Other implementations may use IGT's open, Ethernet-based SuperSAS® protocol, which IGT makes available for downloading without charge. Still other protocols, including but not limited to Best of Breed ("BOB"), may be used to implement various implementations of the disclosure. IGT has also developed a gaming-industry-specific transport layer called CASH that rides on top of TCP/IP and offers additional functionality and security.

Here, gaming establishment 905 also includes an RFID network, implemented in part by RFID switches 919 and multiple RFID readers 917. An RFID network may be used, for example, to track objects (such as mobile gaming devices 970, which include RFID tags 927 in this example), patrons, etc., in the vicinity of gaming establishment 905.

As noted elsewhere herein, some implementations of the disclosure may involve "smart" player loyalty instruments, such as player tracking cards, which include an RFID tag. Accordingly, the location of such RFID-enabled player loyalty instruments may be tracked via the RFID network. In this example, at least some of mobile devices 970 may include an RFID tag 927, which includes encoded identification information for the mobile device 970. Accordingly, the locations of such tagged mobile devices 970 may be tracked via the RFID network in gaming establishment 905. Other location-detection devices and systems, such as the global positioning system ("GPS"), may be used to monitor the location of people and/or devices in the vicinity of gaming establishment 905 or elsewhere.

Various alternative network topologies can be used to implement different implementations of the disclosure and/or to accommodate varying numbers of networked devices. For example, gaming establishments with large numbers of gaming machines 921 may require multiple instances of some network devices (e.g., of main network device 925, which combines switching and routing functionality in this example) and/or the inclusion of other network devices not shown in FIG. 9. Some implementations of the disclosure may include one or more middleware servers disposed between kiosks 977, RFID switches 919 and/or bank switches 915 and one or more devices in computer room 920 (e.g., a corresponding server). Such middleware servers can provide various useful functions, including but not limited to the filtering and/or aggregation of data received from switches, from individual gaming machines and from other devices. Some implementations of the disclosure include load-balancing methods and devices for managing network traffic.

Storage devices 911, Sb™ server 930, License Manager 931, Arbiter 933, servers 932, 934, 936 and 938, host device (s) 960 and main network device 925 are disposed within computer room 920 of gaming establishment 905. In practice, more or fewer devices may be used. Depending on the implementation, some such devices may reside in gaming establishment 905 or elsewhere.

One or more devices in central system 963 may also be configured to perform, at least in part, tasks specific to the present disclosure. For example, one or more servers 962, storage devices 964 and/or host devices 960 of central system 963 may be configured to implement the functions described in detail elsewhere herein. These functions may include, but are not limited to, providing functionality for devices such as player tracking account server 535 and account creation server 540.

One or more of the servers of computer room 920 may be configured with software for receiving a player's wager gaming notification parameters, determining when a wagering condition corresponds with the wager gaming notification parameters and/or providing a notification to the player when the wagering condition corresponds with the wager gaming notification parameters. Moreover, one or more of the servers may be configured to provide functionality such as that provided by player tracking account server 535 and account creation server 540.

Other devices that may be deployed in network 905 do not appear in FIG. 9. For example, some gaming networks may include not only various radio frequency identification ("RFID") readers 917, but also RFID switches, middleware servers, etc., some of which are not depicted in FIG. 9. These features may provide various functions. For example, a server (or another device) may determine a location of a mobile device 970 according to the location of an RFID reader that reads an RFID tag 927.

The servers and other devices indicated in FIG. 9 may be configured for communication with other devices in or outside of gaming establishment 905, such as host devices 960, kiosks 977 and/or mobile devices 970, for implementing some methods described elsewhere herein. Servers (or the like) may facilitate communications with such devices, receive and store patron data, provide appropriate responses, etc., as described elsewhere herein.

Some of these servers may be configured to perform tasks relating to accounting, player loyalty, bonusing/progressives, configuration of gaming machines, etc. One or more such devices may be used to implement a casino management system, such as the IGT Advantage™ Casino System suite of applications, which provides instantaneous information that may be used for decision-making by casino managers. A Radius server and/or a DHCP server may also be configured for communication with the gaming network. Some implementations of the disclosure provide one or more of these servers in the form of blade servers.

Some implementations of Sb™ server 930 and the other servers shown in FIG. 9 include (or are at least in communication with) clustered CPUs, redundant storage devices, including backup storage devices, switches, etc. Such storage devices may include a "RAID" (originally redundant array of inexpensive disks, now also known as redundant array of independent disks) array, back-up hard drives and/or tape drives, etc.

In some implementations of the disclosure, many of these devices (including but not limited to License Manager 931, servers 932, 934, 936, and 938, and main network device 925) are mounted in a single rack with Sb™ server 930. Accordingly, many or all such devices will sometimes be referenced in the aggregate as an "Sb™ server." However, in alternative implementations, one or more of these devices is in communication with Sb™ server 930 and/or other devices of the network but located elsewhere. For example, some of the devices could be mounted in separate racks within computer room 920 or located elsewhere on the network. Moreover, it can be advantageous to store large volumes of data elsewhere via a storage area network ("SAN").

Computer room 920 may include one or more operator consoles or other host devices that are configured for communication with other devices within and outside of computer room 920. Such host devices may be provided with software, hardware and/or firmware for implementing various implementations of the disclosure. However, such host devices need not be located within computer room 920. Wired host devices 960 (which are desktop and laptop computers in this example) and wireless devices 970 (which are PDAs in this example) may be located elsewhere in gaming establishment 905 or at a remote location.

These and other aspects of the disclosure may be implemented by various types of hardware, software, firmware, etc. For example, some features of the disclosure may be implemented, at least in part, by machine-readable media that include program instructions, state information, etc., for performing various operations described herein. Examples of program instructions include both machine code, such as produced by a compiler, and files containing higher-level code that may be executed by the computer using an interpreter. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices ("ROM") and random access memory ("RAM").

Any of the above implementations may be used alone or together with one another in any combination. Although various implementations may have been motivated by various deficiencies with the prior art, which may be discussed or alluded to in one or more places in the specification, the implementations do not necessarily address any of these deficiencies. In other words, different implementations may address different deficiencies that may be discussed in the specification. Some implementations may only partially address some deficiencies or just one deficiency that may be discussed in the specification, and some implementations may not address any of these deficiencies.

While various implementations have been described herein, it should be understood that they have been presented by way of example only, and not limitation. Thus, the breadth and scope of the present application should not be limited by any of the implementations described herein, but should be defined only in accordance with the following and later-submitted claims and their equivalents.

It will be understood that unless features in any of the above-described implementations are expressly identified as incompatible with one another or the surrounding context implies that they are mutually exclusive and not readily combinable in a complementary and/or supportive sense, the totality of this disclosure contemplates and envisions that specific features of those implementations can be selectively combined to provide one or more comprehensive, but slightly different, technical solutions. It will therefore be further appreciated that the above description has been given by way of example only and that modifications in detail may be made within the scope of the invention.

What is claimed is:

1. A wager gaming method comprising:

receiving an input indicating a first player tracking account;

receiving an input authenticating the first player tracking account, the input authenticating the first player tracking account being different from the input indicating the first player tracking account;

providing a first level of access to the first player tracking account after the input indicating the first player tracking account and the input authenticating the first player tracking account are received;

receiving, while the first level of access is provided, an input indicating a request for a first temporary ID associated with the first player tracking account;

issuing the first temporary ID;

receiving an input indicating the first temporary ID;

providing, without requiring authentication of the first player tracking account and responsive to the input indicating the first temporary ID, a second level of access to the first player tracking account, wherein the second level of access is less than the first level of access.

2. The wager gaming method of claim 1, wherein the first level of access:

permits accrual of points or awards to the first player tracking account, permits issuance of temporary IDs, including the first temporary ID, permits spending or redemption of points or awards from the first player tracking account, and permits access to personal data or authentication data of a first player associated with the first player tracking account, and the second level of access:

permits accrual of points or awards to the first player tracking account, does not permit issuance of a secondary temporary ID, does not permit spending or redemption of points or awards from the first player tracking account, and does not permit access to personal data or authentication data of the first player associated with the first player tracking account.

3. The wager gaming method of claim 2, further comprising offering, after the second level of access to the first player tracking account is provided, to open a second player tracking account associated with a player using the first temporary ID to which the player will have the first level of access.

4. The wager gaming method of claim 3, further comprising:

receiving an input indicating that the player accepts the offer;

requesting account data sufficient to create the second player tracking account;

receiving the account data sufficient to create the second player tracking account;

creating the second player tracking account; and transferring points or awards accrued to the first player tracking account under the second level of access by the player to the second player tracking account.

5. The wager gaming method of claim 3, further comprising:

receiving an input indicating that the player accepts the offer;

requesting account data sufficient to create the second player tracking account;

receiving the account data sufficient to create the second player tracking account;

creating the second player tracking account; and duplicating, in the second player tracking account, points or awards accrued to the first player tracking account under the second level of access by the player.

6. The wager gaming method of claim 3, further comprising:

receiving an input indicating that the player accepts the offer;

requesting account data sufficient to create the second player tracking account;

receiving the account data sufficient to create the second player tracking account;

creating the second player tracking account; and providing points or an award to the first player tracking account.

7. The wager gaming method of claim 1, the method further comprising:

disallowing all access to the first player tracking account under the first temporary ID after a predetermined period of time has elapsed; and offering to open a second player tracking account associated with a player using the first temporary ID to which the player will have the first level of access.

8. A gaming machine comprising:

an input device;

a temporary ID reading device;

a master gaming controller;

a temporary ID issuance device; and a communications interface, wherein the input device, the temporary ID reading device; the communications interface, the temporary ID issuance device, and the master gaming controller are communicatively connected and configured to:

receive an input indicating a temporary ID via the temporary ID reading device, wherein the temporary ID is associated with a first player tracking account and was created in response to a request made while the first player tracking account was accessed using a first level of access; and provide, without requiring authentication of the first player tracking account and responsive to receiving the input indicating the temporary ID, a second level of access to the first player tracking account, wherein the second level of access is less than the first level of access.

9. The gaming machine of claim 8, wherein the first level of access:

permits accrual of points or awards to the first player tracking account, permits issuance of temporary IDs, including the temporary ID, permits spending or redemption of points or awards from the first player tracking account, and permits access to personal data or authentication data of a first player associated with the first player tracking account, and the second level of access:

permits accrual of points or awards to the first player tracking account, does not permit issuance of a secondary temporary ID, does not permit spending or redemption of points or awards from the first player tracking account, and does not permit access to personal data or authentication data of the first player associated with the first player tracking account.

10. The gaming machine of claim 9, wherein the input device, the temporary ID reading device, the communications interface, the temporary ID issuance device, and the master gaming controller are further configured to offer to open a second player tracking account associated with a player using the temporary ID to which the player will have the first level of access.

11. The gaming machine of claim 10, wherein the input device, the temporary ID reading device, the communications interface, the temporary ID issuance device, and the master gaming controller are further configured to:

receive an input via the input device indicating that the offer is accepted;

request account data sufficient to create the second player tracking account; and transmit the account data to a player tracking server.

12. The gaming machine of claim 8, wherein the input device, the temporary ID reading device, the communications interface, the temporary ID issuance device, and the master gaming controller are further configured to:

disallow all access to the first player tracking account under the temporary ID after a predetermined period of time has elapsed; and offer to open a second player tracking account associated with a player using the temporary ID to which the player will have the first level of access.

13. A wager gaming system comprising:

an input device;

a temporary ID issuance device;

a temporary ID reading device; and a player tracking server, wherein the input device, the temporary ID issuance device, the temporary ID reading device, and the player tracking server are communicatively connected and configured to:

receive an input indicating a first player tracking account;

receive an input authenticating the first player tracking account, the input authenticating the first player tracking account being different from the input indicating the first player tracking account;

provide a first level of access to the first player tracking account after the input indicating the first player tracking account and the input authenticating the first player tracking account are received;

receive, while the first level of access is provided, an input via the input device indicating a request for a first temporary ID associated with the first player tracking account;

issue the first temporary ID using the temporary ID issuance device;

receive an input indicating the first temporary ID via the temporary ID reading device;

provide, without requiring authentication of the first player tracking account and responsive to receiving the input indicating the first temporary ID, a second level of access to the first player tracking account, wherein the second level of access is less than the first level of access.

14. The wager gaming system of claim 13, wherein the first level of access:

permits accrual of points or awards to the first player tracking account, permits issuance of temporary IDs, including the first temporary ID, permits spending or redemption of points or awards from the first player tracking account, and permits access to personal data or authentication data of a first player associated with the first player tracking account, and the second level of access:

permits accrual of points or awards to the first player tracking account, does not permit issuance of a secondary temporary ID, does not permit spending or redemption of points or awards from the first player tracking account, and does not permit access to personal data or authentication data of the first player associated with the first player tracking account.

15. The wager gaming system of claim 14, wherein the input device, the temporary ID issuance device, the temporary ID reading device, and the player tracking server are further configured to: offer, after the second level of access to the first player tracking account is provided, to open a second player tracking account associated with a player using the first temporary ID to which the player will have the first level of access.

16. The wager gaming system of claim 15, wherein the input device, the temporary ID issuance device, the temporary ID reading device, and the player tracking server are further configured to:

receive an input indicating that the player accepts the offer;

request account data sufficient to create the second player tracking account;

receive the account data sufficient to create the second player tracking account;

create the second player tracking account; and transfer points or awards accrued to the first player tracking account under the second level of access by the player to the second player tracking account.

17. The wager gaming system of claim 15, wherein the input device, the temporary ID issuance device, the temporary ID reading device, and the player tracking server are further configured to:

receive an input indicating that the player accepts the offer;

request account data sufficient to create the second player tracking account;

receive the account data sufficient to create the second player tracking account;

create the second player tracking account; and duplicate, in the second player tracking account, points or awards accrued to the first player tracking account under the second level of access by the player.

18. The wager gaming system of claim 15, wherein the input device, the temporary ID issuance device, the temporary ID reading device, and the player tracking server are further configured to:

receive an input indicating that the player accepts the offer;

request account data sufficient to create the second player tracking account;

receive the account data sufficient to create the second player tracking account;

create the second player tracking account; and provide points or an award to the first player tracking account.

19. The wager gaming system of claim 13, wherein the input device, the temporary ID issuance device, the temporary ID reading device, and the player tracking server are further configured to:

disallow all access to the first player tracking account under the first temporary ID after a predetermined period of time has elapsed; and offer to open a second player tracking account associated with a player using the first temporary ID to which the player will have the first level of access.

* * * * *